US011427435B2

(12) United States Patent
Harel

(10) Patent No.: US 11,427,435 B2
(45) Date of Patent: Aug. 30, 2022

(54) SYSTEM AND METHOD FOR MAINTENANCE OF SHABBAT ELEVATORS

(71) Applicant: Sagie Harel, Nili (IL)

(72) Inventor: Sagie Harel, Nili (IL)

( * ) Notice: Subject to any disclaimer, the term of this patent is extended or adjusted under 35 U.S.C. 154(b) by 988 days.

(21) Appl. No.: 16/140,566

(22) Filed: Sep. 25, 2018

(65) Prior Publication Data

US 2019/0092602 A1 Mar. 28, 2019

(30) Foreign Application Priority Data

Sep. 25, 2017 (IL) ..... 254691

(51) Int. Cl.
*B66B 5/00* (2006.01)
*B66B 1/34* (2006.01)

(52) U.S. Cl.
CPC ..... *B66B 5/0025* (2013.01); *B66B 1/343* (2013.01); *B66B 1/3453* (2013.01)

(58) Field of Classification Search
CPC ..... B66B 5/0025; B66B 1/343; B66B 1/3453
See application file for complete search history.

(56) References Cited

U.S. PATENT DOCUMENTS 6,742,634 B2 6/2004 Watanabe
8,499,895 B2 8/2013 Zweig
8,893,858 B2 11/2014 Shi
9,481,548 B2 11/2016 Siddiqui
9,580,276 B2 2/2017 Toutaoui
10,564,618 B2 * 2/2020 Lavie ..... G05B 19/07
2011/0100758 A1 * 5/2011 Zweig ..... B66B 1/468 187/247
2011/0112943 A1 5/2011 Dietz
2011/0273283 A1 11/2011 Schmuttor
2013/0126277 A1 * 5/2013 Friedman ..... B66B 3/00 187/384
2014/0174860 A1 * 6/2014 Yakuel ..... B66B 17/12 187/250
2014/0200730 A1 * 7/2014 Lavie ..... G05B 19/07 700/296
2014/0364272 A1 * 12/2014 Shapira ..... B66B 11/0484 477/3
2019/0300336 A1 * 10/2019 Witczak ..... B66B 5/0087

FOREIGN PATENT DOCUMENTS

CN 102718100 10/2012
WO 2013035060 3/2013

* cited by examiner

*Primary Examiner* — Jeffrey Donels
(74) *Attorney, Agent, or Firm* — Alphapatent Associates, Ltd; Daniel J. Swirsky

(57) ABSTRACT

A method for maintenance of an elevator in Shabbat mode, the method including providing a Shabbat elevator maintenance system, where the system is in communication with the elevator, detecting a malfunction in the elevator by the maintenance system, notifying a technician about the malfunction by the maintenance system, following repair of the elevator by a repairing technician, verifying by the maintenance system that the elevator has been repaired and that Shabbat mode has been reactivated, and activating remuneration for the repairing technician by the maintenance system.

12 Claims, 4 Drawing Sheets

SYSTEM AND METHOD FOR MAINTENANCE OF SHABBAT ELEVATORS

FIELD

The invention relates to a system and method for elevator maintenance and particularly for maintenance of elevators operating in Shabbat mode.

BACKGROUND

Orthodox Jews who observe the Sabbath (also referred to herein as Shabbat) avoid performing those activities that are regarded as prohibited for the duration of the day. The operation of an electrical appliance or any change in the operation of an electrical appliance is prohibited. Therefore, in order to use an elevator on Shabbat, the elevator must be modified in order for its use to be considered permitted. A Sabbath elevator generally stops at every floor or most floors going up or down or in both directions. In this way observant Jews can use the elevator without pushing any buttons. Additionally, the door obstruction detection mechanism is typically disabled while the door is open, with a buzzer sounding to warn users that the mechanism is about to reactivate and the doors are about to close. While these adaptations are considered acceptable to most orthodox Jews, there is a further aspect of elevator operation on Sabbath that most users are not aware of.

Reference is now made to FIG. 1A which is a schematic diagram of a prior art elevator system. As shown one or more elevators 110 are installed at one or more remote sites 105. The elevators 110 at each site 105 are controlled by control panel 114. Shabbat mode is usually activated at panel 114 for one or more of elevators 110. If a fault occurs in one of elevators 110, then a maintenance organization associated with elevators 110 is contacted by an individual at site 105 such as by phone or message. The maintenance organization then usually sends a repairman/technician to repair the elevator 110 with the fault. To repair the fault, it will be necessary to stop the Shabbat mode in order to hold the elevator in a stopped position or to prevent passengers riding in it while it is being repaired. Once the repair is complete the technician re-enables Shabbat mode and leaves the site 105.

Any intervention in the operation of the elevator by a Jewish individual, such as a Jewish technician who returns a faulty elevator to working service on the Sabbath, disqualifies the elevator from Shabbat usage since this activity is not allowed on the Sabbath and users of the elevator are not allowed to benefit from prohibited activity (even if performed by another Jew). In fact, the act of phoning/messaging the lift maintenance company, by a Jew or non-Jew, resulting in a repair of the elevator, renders the elevator unfit for use. Further, observant Jews are not allowed to use the services of non-Jews to perform prohibited Sabbath tasks unless these actions are performed for the benefit of the non-Jew. Therefore, any intervention in the operation of the elevator by a non-Jew, who does not perform the act as required (for his own benefit), also disqualifies the elevator from Shabbat usage. In most cases the observant Jewish users are not aware of the malfunction or repair and thus do not realize that that the elevator has been rendered unfit for use.

Therefore, if a Shabbat elevator malfunctions during the Shabbat, there is currently no permissible way to call for assistance or return the elevator to service. There is therefore a need for a system or method for monitoring and repairing Shabbat elevators during the period of the Sabbath such that the elevator remains useable by observant Jews.

While most elevators include sensors, such as to determine weight of the load, door open/close status or that the elevator is at a certain floor, there is a need for an elevator with a more enhanced set of sensors for detecting a broader range of conditions or faults in an elevator.

SUMMARY

The invention, in an embodiment thereof, overcomes the drawbacks of the prior art by providing a system and method for monitoring and repair of a Shabbat elevator such that the elevator remains useable by observant Jews. The invention thus aims to supervise any intervention in the operation/maintenance of the elevator during the Sabbath and to prevent accidental desecration of the Sabbath.

The invention, in an embodiment thereof, maintains a Shabbat elevator in a permissible condition by:

- Automatically notifying a control center of changes to the Shabbat mode and to the existence of malfunctions; this automatic notification takes place without the need for anyone on site to phone or otherwise notify the maintenance organization.
- Providing an immediate incentive for the non-Jewish technician to complete the repair and return the elevator to Shabbat mode; by linking the technician's remuneration to successful completion of the repair and reactivating the Shabbat mode, the technician may be said to be performing the repair for his own benefit—which renders the non-Jew's activities permissible.

To enable this functionality, the system comprises sensors and a controller module that are added to an existing elevator to monitor the activation/deactivation of Shabbat mode and also to report malfunctions to a central server. Alternatively, a new elevator installation comprises the controller and sensors of the invention. The central server then notifies an authorized technician (non-Jewish) who can connect remotely to the controller module using a dedicated app to attempt to diagnose the malfunction. Once the technician has diagnosed the problem, a remote repair can be attempted such as resetting the elevator. Alternatively, if no remote repair is possible the technician is directed to travel to the repair site by the app. Before performing the repair, the technician disables the Shabbat mode (on site or via the technician app), or alternatively having determined that there is a fault, Shabbat mode is disabled by the controller module or the central server. Once the repair is complete the technician must first re-enable Shabbat mode before being allowed to report the repair as complete and get remuneration for performing the repair. If the technician does not re-enable Shabbat mode, then remuneration for the technician is not activated.

The system of the invention, in an embodiment thereof, also monitors the use of Shabbat mode to prevent inadvertent Shabbat desecration, for example: should the hotel staff activate Shabbat mode once Shabbat has already started, then the elevator would not be considered acceptable for use. Thus, the system checks the activation time and the local Shabbat entry time to confirm that the Shabbat mode was activated on time. Local Shabbat entry time is determined based on, for example, the calculated sunset times at the geographic coordinates of the elevator. If not, then the system can disable Shabbat mode to prevent inadvertent desecration. Alternatively, the system itself can activate Shabbat mode—doing so at a time that is known to be early enough.

According to some embodiments of the invention a method for maintenance of an elevator in Shabbat mode comprises: providing a Shabbat elevator maintenance system; wherein said system is in communication with said elevator; detecting a malfunction in said elevator by said maintenance system; notifying a technician about said malfunction by said maintenance system; following repair of said elevator by a technician: verifying by said maintenance system that said elevator has been repaired and that Shabbat mode has been reactivated; and activating remuneration for the repairing technician by said maintenance system. Preferably said elevator comprises a control panel and said maintenance system is adapted to communicate with said control panel via a controller. Preferably said maintenance system further comprises a server and an app in communication with said server for said notifying of a technician. Preferably said app provides for remote maintenance of said elevator. Preferably said maintenance system further comprises sensors for detecting said malfunction in said elevator. Preferably said sensors comprise one or more of audio sensors, vibration sensors, cameras, or temperature sensors.

According to further embodiments of the invention a method for maintenance of an elevator in Shabbat mode comprises: providing a Shabbat elevator maintenance system comprising a controller module and a server; wherein said controller module is in communication with said elevator and said server; detecting a malfunction in said elevator by said controller; notifying a technician about said malfunction by said server; following repair of said elevator by a technician: verifying by said server that said elevator has been repaired; and activating remuneration for the repairing technician by said server. Preferably said elevator comprises a control panel and said controller is adapted to communicate with said control panel.

Preferably said maintenance system further comprises an app in communication with said server for said notifying of a technician. Preferably said app provides for remote maintenance of said elevator. Preferably said maintenance system further comprises sensors for detecting said malfunction in said elevator. Preferably said sensors comprise one or more of audio sensors, vibration sensors, cameras, or temperature sensors.

According to further embodiments of the invention a method for maintenance of an elevator in Shabbat mode comprises: providing a Shabbat elevator maintenance system comprising a controller module and a server; wherein said controller module is in communication with said elevator and said server; detecting a malfunction in said elevator by said controller; notifying a technician about said malfunction by said server; deactivating Shabbat mode in said elevator; following repair of said elevator by a technician: verifying by said server that said elevator has been repaired and that Shabbat mode has been reactivated; and activating remuneration for the repairing technician by said server. Preferably said elevator comprises a control panel and said controller is adapted to communicate with said control panel. Preferably said maintenance system further comprises an app in communication with said server for said notifying of a technician. Preferably said app provides for remote maintenance of said elevator. Preferably said maintenance system further comprises sensors for detecting said malfunction in said elevator. Preferably said sensors comprise one or more of audio sensors, vibration sensors, cameras, or temperature sensors.

According to further embodiments of the invention a system for maintenance of an elevator in Shabbat mode comprises: a controller module, a server; wherein said controller module is in communication with said elevator and said server; wherein said controller detects a malfunction in said elevator; wherein said server notifies a technician about said malfunction; wherein Shabbat mode is deactivated in said elevator; wherein following repair of said elevator by a technician: said server verifies that said elevator has been repaired and that Shabbat mode has been reactivated; and wherein said server activates remuneration for the repairing technician.

Preferably said elevator comprises a control panel and said controller is adapted to communicate with said control panel. Preferably the system further comprises an app in communication with said server for said notifying of a technician. Preferably the app provides for remote maintenance of said elevator. Preferably the system further comprises sensors for detecting said malfunction in said elevator. Optionally said sensors comprise one or more of audio sensors, vibration sensors, cameras, or temperature sensors.

According to further embodiments of the invention a method for operation of a Shabbat elevator comprises: providing a Shabbat elevator maintenance system comprising a controller module; determining the time when Shabbat starts; monitoring said elevator to determine when Shabbat mode is activated; when Shabbat mode is activated after the start of Shabbat deactivating Shabbat mode for said elevator; and when Shabbat mode is activated before Shabbat starts, continuing to monitor said elevator for changes to Shabbat mode.

According to further embodiments of the invention a method for operation of a Shabbat elevator comprises: providing a Shabbat elevator maintenance system comprising a controller module; determining the time when Shabbat will start; before the start of Shabbat, determining whether Shabbat mode has been activated for said elevator; when Shabbat mode has not been activated, activating Shabbat mode for said elevator. Preferably said determining whether Shabbat mode has been activated takes place between 1 minute and 30 minutes before Shabbat. Preferably the method further comprises monitoring said elevator for deactivation of Shabbat mode and when a deactivation is detected, preventing reactivation of Shabbat mode.

According to further embodiments of the invention a method for maintenance of an elevator comprises: providing an elevator maintenance system; wherein said system is in communication with said elevator; wherein said maintenance system comprises sensors for detecting a malfunction in said elevator; monitoring said sensors and storing monitored sensor data obtained from said sensors; and determining that a malfunction has occurred or will occur in said elevator; wherein said determining comprises at least one of: comparing current data from said sensors and said stored sensor data; or comparing current data to expected data. Preferably the method further comprises notifying a technician about said malfunction by said maintenance system. Preferably said maintenance system further comprises a server and an app in communication with said server for said notifying of a technician. Preferably said app provides for remote maintenance of said elevator. Preferably said sensors comprise one or more of audio sensors, vibration sensors, cameras, or temperature sensors. Preferably said elevator comprises a control panel and said maintenance system is adapted to communicate with said control panel via a controller.

The terms elevator or lift may be used interchangeably herein and have the same meaning. The terms Sabbath or Shabbat may be used interchangeably herein and have the same meaning, namely, the Jewish Sabbath observed from near sundown on Friday evening to around stars-out on Saturday night. Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the invention involves performing or completing certain selected tasks or steps manually, automatically, or a combination thereof. Moreover, according to actual instrumentation and equipment of embodiments of the method and system of the invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

Although the invention is described with regard to a "controller", "computing device", a "computer", or "mobile device", it should be noted that these devices and optionally any device featuring a data processor and the ability to execute one or more instructions may be described as a computer, including but not limited to any type of personal computer (PC), a server, a distributed server, a virtual server, a cloud computing platform, a cellular telephone, an IP telephone, a smartphone, or a PDA (personal digital assistant). Any two or more of such devices in communication with each other may optionally comprise a "network" or a "computer network".

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the embodiments of the invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION

Figure 1A:
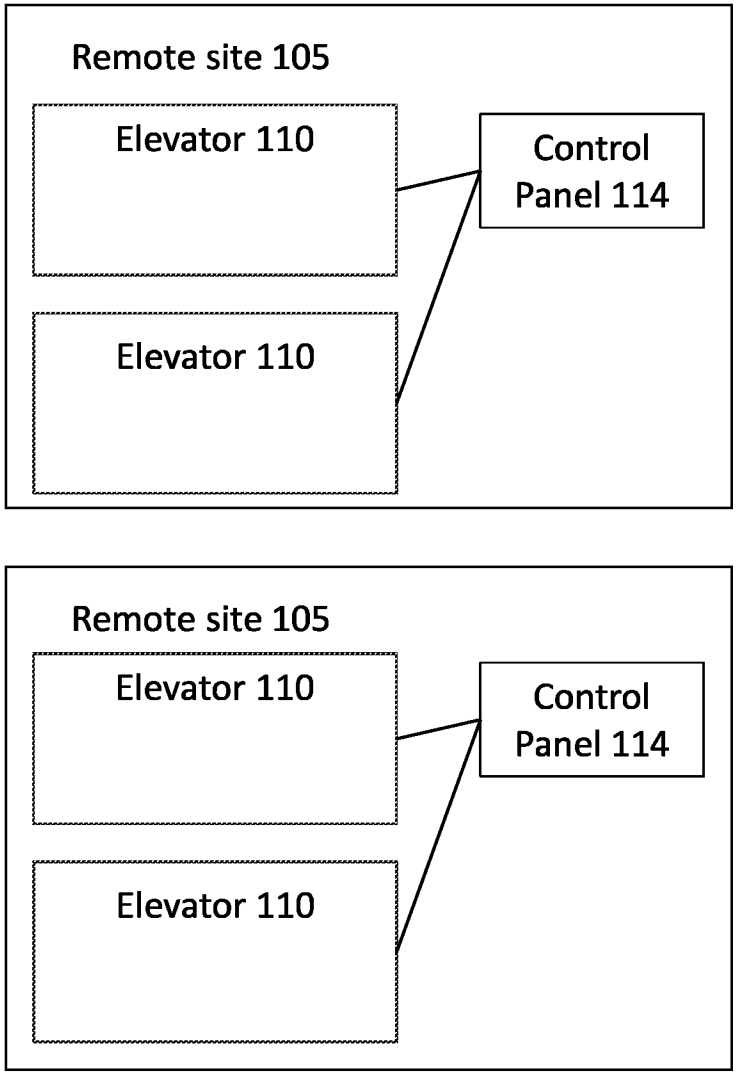
Figure 1A Prior Art
FIG. 1A is a schematic diagram of a prior art elevator system.
Figure 1B:
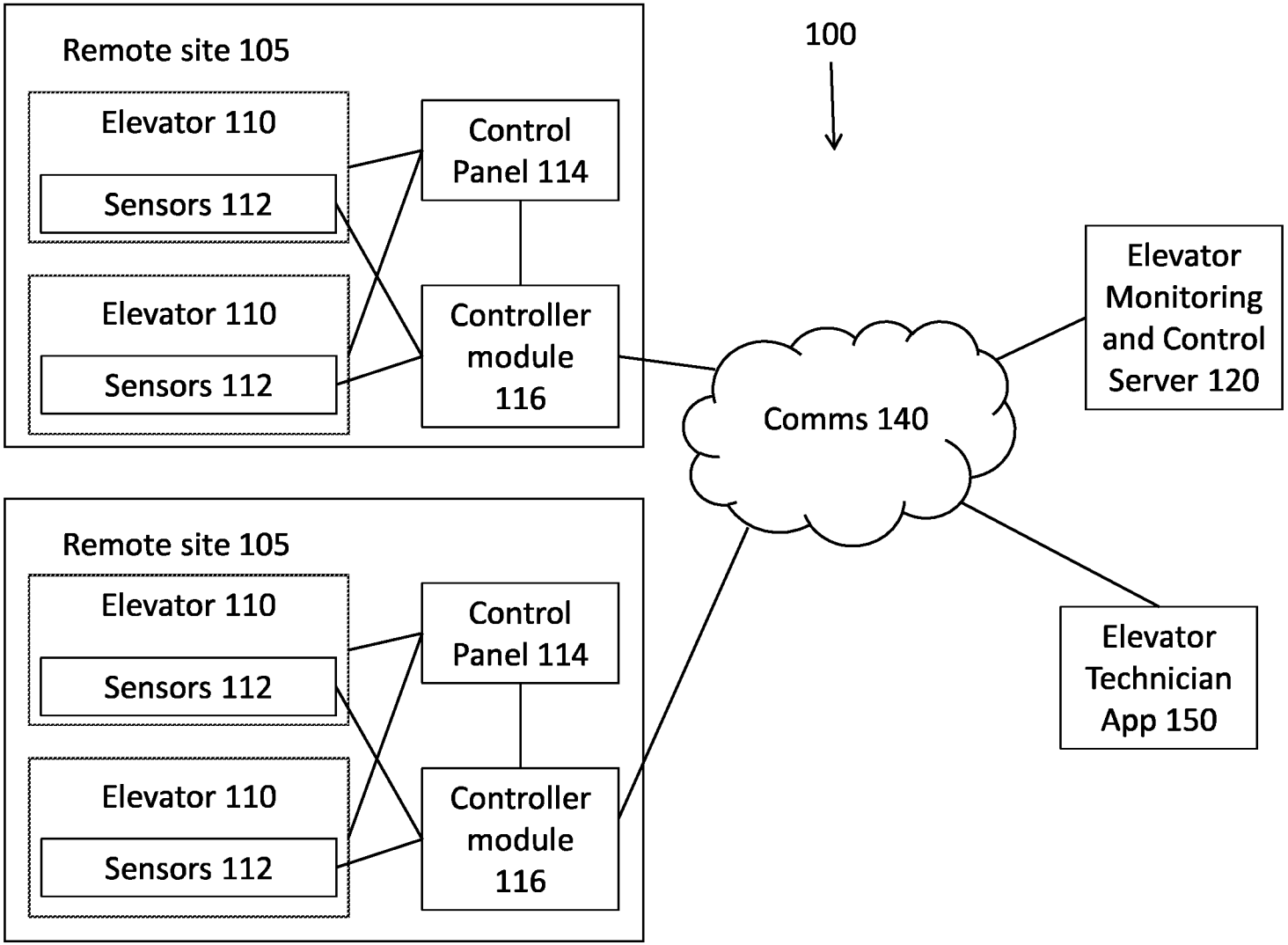
FIG. 1B is a schematic diagram of a maintenance system for a Shabbat elevator according to at least some embodiments of the invention.

The invention in at least some embodiments is a system and method for monitoring and repair of a Shabbat elevator such that the elevator remains useable by observant Jews. Reference is now made to FIG. 1B is a schematic diagram of a maintenance system 100 for a Shabbat elevator according to at least some embodiments of the invention. As shown in FIG. 1B one or more elevators 110 are installed at one or more remote sites 105. The elevators 110 at each site 105 are controlled by control panel 114. Shabbat mode is usually activated at panel 114 for one or more of elevators 110.

Elevators 110 are equipped with sensors 112 for detecting faults. Sensors 112 are provided in addition to existing sensors in the elevator 110 or alternatively are provided as part of elevator 110. Non-limiting examples of sensors 112 include audio, vibration, cameras, temperature and so forth. Sensors 112 feed captured sensor data to controller module 116. Controller module 116 is a computing device as defined above. Controller module 116 analyzes the data received from sensors 112 to determine whether elevator 110 is malfunctioning.

Alternatively, controller module 116 can determine whether elevator 110 is about to malfunction or has the potential to malfunction and is exhibiting behavior that is indicative of future failure. Optionally such a determination is based on comparison to a database of expected behavior or values for the specific elevator or elevator component or sensor data. Alternatively or additionally, such a determination is based on analysis of historical behavior of the elevator or elevator component. Non-limiting examples include vibrations or temperature that exceed recommended or expected values. Analyzing historical data comprises storing data received from sensors 112 and comparing current data to the stored historical data to detect changes or anomalies. Preferably current data is data collected in the immediately preceding time period which may be any relevant period including 1 second, 1 minute, 1 hour, 1 day, or 1 month. Historical data may refer to any collected data over any period from the immediately preceding 1 minute to 1 year to multiple years. Optionally the historical data is used to build a model of expected behavior or data for a specific elevator type or for general elevator operation. Optionally this built model is compared to current elevator data from sensors 112 to determine fault, developing fault or potential fault conditions. Optionally sensor data is provided to control panel 114 which analyzes the data received from sensors 112 to determine whether elevator 110 is malfunctioning.

Controller module 116 is also connected to control panel 114 for detecting the current status of elevators 110. Status may include current position, load, and whether Shabbat mode is activated or not. Controller module 116 is adapted to interface to multiple different control panel types as manufactured for different lift vendors and types of elevators. In one embodiment, controller module 116 is installed into an existing elevator installation and adds functionality as described herein to existing panel 114. In a further embodiment panel 114 is integrated into controller module 116 as a single computing device, such as the non-limiting example where both are installed concurrently.

Controller module 116 preferably can control and make changes to control panel 114. As a non-limiting example, controller 116 can activate or deactivate Shabbat mode, or can perform any activities that are provided via panel 114. Controller module 116 is preferably programmed with the coordinate location of site 105 where it is installed. These coordinates enable controller 116 to calculate the start and end times for Shabbat based on calculated sunset times. These times can then be used to determine whether Shabbat mode needs to be activated or not.

As shown, multiple remote sites 105 can have similar configurations each comprising a controller module 116 configured to interact with the local control panel 114 and monitor data from local sensors 122. Although FIG. 2B shows two remote sites 105 and limited number of elevators 110, it should be appreciated that maintenance system 100 can accommodate any number of sites 105, and elevators 110.

Controller modules 116 are connected to a communications (comms) network 140. Network 140 is preferably any comms network as known in the art including but not limited to a wired communication network, an optical communication network, a fiber-optic communication network, the Internet, a LAN, a WAN and the like or RF network, and/or any combination of the aforesaid networks, which may optionally be private or public networks; and a wireless data network including but not limited to a cellular network, or use any wireless technology or protocol not limited to WiMAX, EVDO, RTT, HSPA, EDGE, GPRS, Wi-Fi, UMTS, LTE, 3G, 4G or 5G, and/or any combination of the aforesaid networks. Combinations of wired and wireless networks may also optionally be employed.

Controller module 116 communicates with elevator monitoring and control server 120 which runs on a server or other computing device. Server 120 collects data concerning elevators 100 at all of sites 105. When an elevator 110 is discovered to be in a fault condition, either based on sensor 112 data sent to controller module 116 or from elevator status data extracted from control panel 114 by controller module 116, this fault condition is reported to server 120. Server 120 can then communicate with elevator technician application (app) 150 to indicate the determined fault status of one of elevators 110. App 150 is preferably a mobile app running on a mobile device but may also run on any computing device. App 150 notifies an elevator technician that an elevator 110 is malfunctioning and the technician can then attempt to remotely diagnose the issue using app 150 as described further below. Interaction with app 150 is via the display and interaction hardware of the device.

Alternatively, controller 116 comprises the functionality of server 120 on the same computing device and determines that a fault condition has occurred and communicates directly with a technician via app 150 such that no separate server 120 is provided. Alternatively, server 120 is collocated with controller 116. Alternatively, server 120 comprises the functionality of app 150 and reports a fault status via, for example, a connected display device such that the technician interacts with controller 116 and the elevator 110 directly via server 120 wherein said interaction takes place through any of a touchscreen, keyboard, mouse, or similar.

Figure 2:
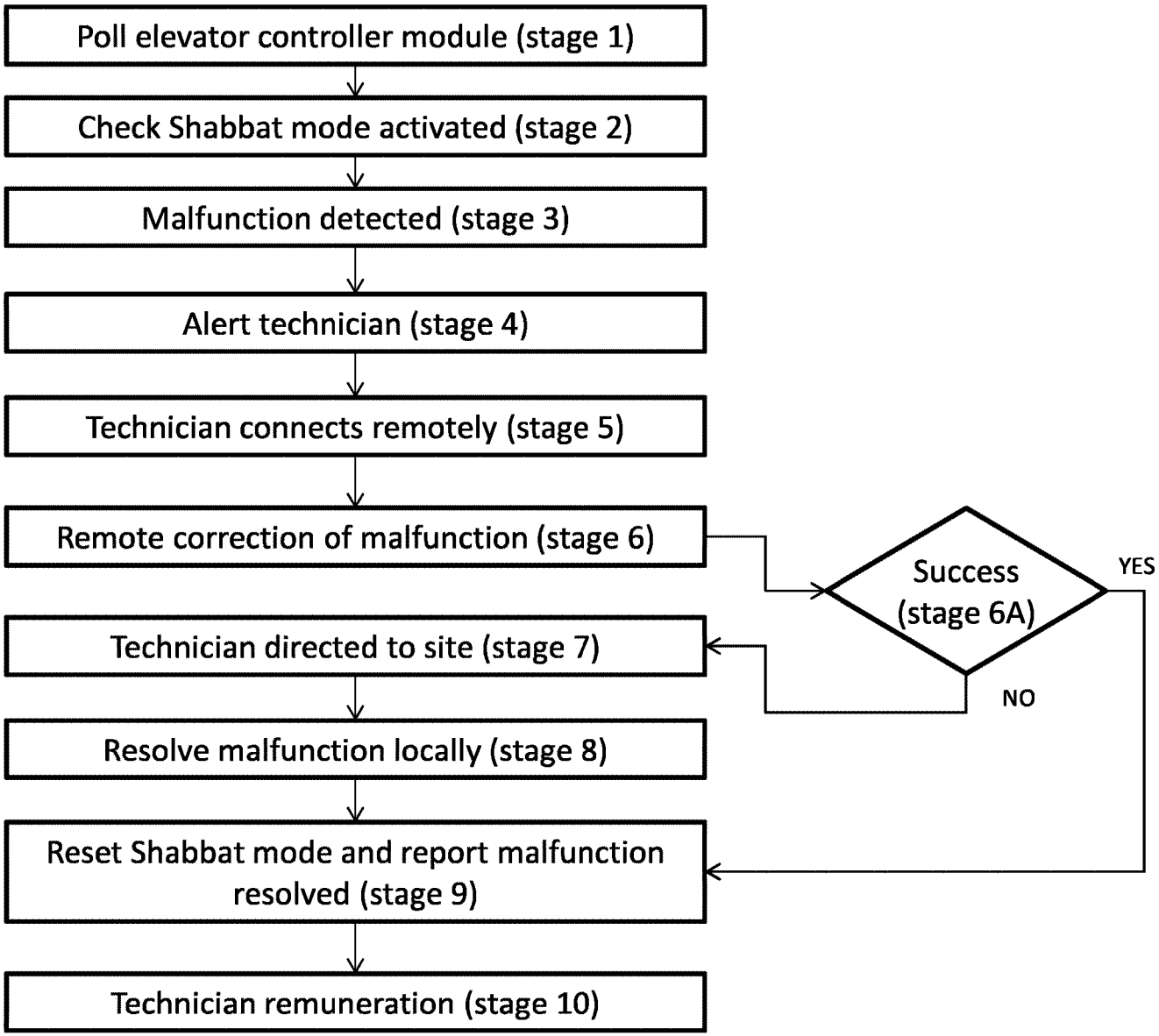
FIG. 2 is a flow diagram showing operation of a Shabbat elevator using a Shabbat maintenance system according to at least some embodiments of the invention.

Reference is now made to FIG. 2 which is a flow diagram showing operation of a Shabbat elevator using a Shabbat maintenance system according to at least some embodiments of the invention. In stage 1, controller module 116 polls control panel 114 for the status of elevators 110, such as the non-limiting status of operational or not. In stage 2, based on the time of day and the day of the week, and having determined that Shabbat is about to start, controller 116 checks whether Shabbat mode is activated for one or more of elevators 110. If Shabbat mode is activated, then controller 116 continues to monitor elevators 110 using sensors 112 and control panel 114 to determine whether elevators 110 have malfunctioned.

In stage 3 it is determined that a malfunction has occurred in one of elevators 110 and this information is communicated to server 120 over comms network 140. In stage 4, server 120 notifies a suitable technician who is preferably non-Jewish as described above. The alert to the technician is preferably via app 150. In stage 5, the technician uses app 150 to remotely connect via comms 140 to the controller module 116 at the site 105 with the malfunctioning elevator 110.

In stage 6, the technician first attempts to diagnose the cause of the malfunction using app 150 based on the data available from controller module 116.

Next, the technician attempts to resolve the malfunction remotely. In a non-limiting example, the technician sends a command to reset the malfunctioning elevator 110 using app 150 which instructs controller module 116 which in turn instructs control panel 114. Optionally it may be necessary to disable Shabbat mode in order to perform the remote repair.

In stage 6A, controller module 116 polls control panel 114 and sensors 112 to determine whether the remote repair attempt has succeeded or not. If the repair has succeeded, then the technician continues as described in in stage 9 below. If the remote repair is determined to be unsuccessful, then, in stage 7, the technician is preferably provided by app 150 with directions to travel to site 105 to repair the elevator on site.

In stage 8 the technician arrives on site and works to diagnose and resolve the malfunction locally. In most cases it will be necessary to disable Shabbat mode on the elevator being repaired. Once the elevator 110 has been repaired, in stage 9, the technician re-enables Shabbat mode and uses app 150 to report that the malfunction has been resolved. Only once stage 9 has been completed and app 150 has notified server 120 of the completion of the repair and server 120 has verified, via communication with controller 116, the re-enabling of Shabbat mode and the repair of elevator 110, will stage 10 be allowed to proceed. In stage 10 remuneration of the technician is activated and the technician will receive remuneration or an indication that remuneration will be now be processed. Server 120 thus provides remuneration to the technician or is in communication with a personnel management server or device and provides an indication to the remuneration server that remuneration may be processed. Remuneration may include but is not limited to any monetary compensation or any other gift or suitable incentive. Thus, the technician is incentivized to complete stage 9 correctly and is thus performing the repair and the re-enabling of Shabbat mode for his own benefit—therefor rendering the repair to be acceptable such that Orthodox Jews may continue to use the repaired elevator.

Figure 3:
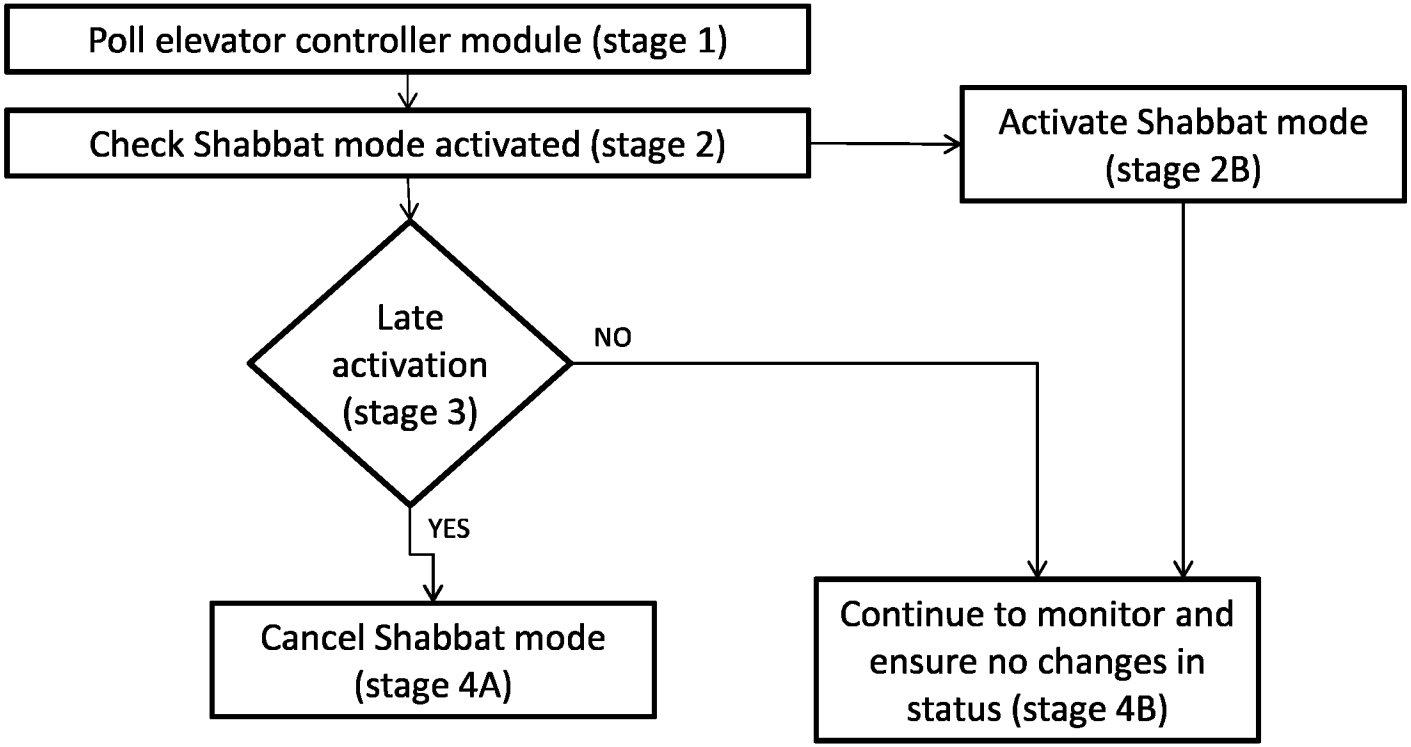
FIG. 3 is a flow diagram showing operation of a Shabbat elevator using a Shabbat maintenance system according to at least some embodiments of the invention.

Reference is now made to FIG. 3 which is a flow diagram showing operation of a Shabbat elevator using a Shabbat maintenance system according to at least some embodiments of the invention. In stage 1, controller module 116 polls control panel 114 for the status of elevators 110. In stage 2, based on the time of day and the day of the week and having determined that Shabbat is about to start, controller 116 checks whether Shabbat mode is activated. Preferably, the check happens between from 1 minute to 1 hour before Shabbat. If it is determined in stage 3 that Shabbat has started and that Shabbat mode has been activated after the start of Shabbat, then in stage 4A Shabbat mode is cancelled. In this way, users of elevator 110 do not inadvertently transgress Shabbat by using an elevator where Shabbat mode was activated after the start of Shabbat. Alternatively, at stage 2B, Shabbat mode is activated by the Shabbat maintenance system before the start of Shabbat.

If Shabbat mode was activated at the right time before the start of Shabbat, then in stage 4B controller 116 and server 120 continue to monitor the elevator/s 110 to ensure that no changes are made to the working of the elevator during Shabbat. If Shabbat mode is disabled during Shabbat, then system 100 prevents Shabbat mode from being re-enabled. The embodiment of FIG. 3 may take place even if comms 140 is not available. In such a case controller 116 acts autonomously without the need for server 120 and enables or disables Shabbat mode as necessary.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the invention.

What is claimed is:

1. A method for maintenance of an elevator in Shabbat mode comprising:

a. providing a Shabbat elevator maintenance system, wherein said system is in communication with said elevator;

b. detecting a malfunction in said elevator by said maintenance system;

c. notifying a technician about said malfunction by said maintenance system;

d. following repair of said elevator by a repairing technician, verifying by said maintenance system that said elevator has been repaired and that Shabbat mode has been reactivated; and e. activating remuneration for the repairing technician by said maintenance system.

2. The method of claim 1 wherein said elevator comprises a control panel and said maintenance system is adapted to communicate with said control panel via a controller.

3. The method of claim 2 wherein said maintenance system further comprises a server and an app in communication with said server for said notifying of a technician.

4. The method of claim 3 wherein said app provides for remote maintenance of said elevator.

5. The method of claim 1 wherein said maintenance system further comprises sensors for detecting said malfunction in said elevator and wherein said sensors are selected from the group consisting of:

a. audio sensors;

b. vibration sensors;

c. cameras;

d. temperature sensors; and e. a combination of the above.

6. A system for maintenance of an elevator in Shabbat mode comprising:

a. a controller module; and b. a server, wherein said controller module is in communication with said elevator and said server, wherein said controller is adapted to detect a malfunction in said elevator; wherein said server is adapted to notify a technician about said detected malfunction and deactivate Shabbat mode in said elevator; wherein following repair of said elevator by a technician: said server is adapted to verify that said elevator has been repaired, that Shabbat mode has been reactivated and to activate remuneration for the repairing technician.

7. The system of claim 6 wherein said elevator comprises a control panel and said controller is adapted to communicate with said control panel.

8. The system of claim 6 further comprising an app in communication with said server for said notifying of a technician.

9. The system of claim 8 wherein said app provides for remote maintenance of said elevator.

10. The system of claim 9 further comprising sensors for detecting said malfunction in said elevator and wherein said sensors are selected from the group consisting of:

a. audio sensors;

b. vibration sensors;

c. cameras;

d. temperature sensors; and e. a combination of the above.

11. The system of claim 7 further comprising an app in communication with said server for said notifying of a technician.

12. A method for operation of an elevator in Shabbat mode, comprising:

a. providing a Shabbat elevator maintenance system comprising a controller module in communication with said elevator;

b. determining the time when Shabbat starts;

c. monitoring said elevator to determine when Shabbat mode is manually activated;

d. when Shabbat mode is manually activated after the start of Shabbat, deactivating Shabbat mode for said elevator; and e. when Shabbat mode is manually activated before Shabbat starts, continuing to monitor said elevator for changes to Shabbat mode.

* * * * *